US005560134A

United States Patent [19]

Van Niekerk et al.

[11] Patent Number: 5,560,134

[45] Date of Patent: Oct. 1, 1996

[54] TRIGGER SAFETY DEVICE FOR A FIREARM AND THE LIKE

[75] Inventors: Pieter W. Van Niekerk; Daniel J. J. Maritz; Kurt K. Prinsloo, all of Verwoerdburg; Jakob De Bruin; Brian Koekemoer, both of Pretoria; Echbertus H. D. Greeff, Verwoerdburg, all of South Africa

[73] Assignee: Denel (PTY) Limited, South Africa

[21] Appl. No.: 590,064

[22] Filed: Jan. 17, 1996

Related U.S. Application Data

[63] Continuation of Ser. No. 348,600, Dec. 2, 1994, abandoned.

[30] Foreign Application Priority Data

Dec. 6, 1993 [ZA] South Africa ..... 93/6547

[51] Int. Cl.[6] ..... F41A 17/22

[52] U.S. Cl. ..... 42/70.06

[58] Field of Search ..... 42/70.06, 70.01, 42/70.04; 89/150

[56] References Cited

U.S. PATENT DOCUMENTS

| | | | |
|---|---|---|---|
| 1,125,578 | 1/1915 | Mauser | 89/150 |
| 2,453,683 | 11/1948 | Caldow | 42/70.04 |
| 2,571,132 | 10/1951 | Harvey | 42/70.06 |

FOREIGN PATENT DOCUMENTS

| | | | |
|---|---|---|---|
| 10493 | 7/1909 | France | 42/70.06 |
| 345118 | 12/1921 | Germany | 42/70.06 |
| 485710 | 6/1929 | Germany | 42/70.06 |
| 24659 | of 1905 | United Kingdom | 42/70.06 |

*Primary Examiner*—Stephen M. Johnson
*Attorney, Agent, or Firm*—Banner & Allegretti, Ltd.

[57] ABSTRACT

A trigger related safety device for a firearm or the like comprising a secondary trigger (24) which is reciprocally movable relative to the main trigger (10) between a first or operative position and a second or inoperative position, and a locking member (35) associated with the secondary trigger (24) which, when the latter is in the said operative position, serves positively to lock the main trigger (10) to a stationery part of the firearm or the like so preventing the main trigger (10) from moving in the direction where the firing mechanism of the firearm will be activated, and when the secondary trigger (24) is in the said inoperative position, the main trigger (10) is free to move in the said direction.

10 Claims, 1 Drawing Sheet

TRIGGER SAFETY DEVICE FOR A FIREARM AND THE LIKE

This application is a continuation of application Ser. No. 08/348,600 filed Dec. 2, 1994 now abandoned.

This invention relates to a trigger related safety device for a firearm or the like.

It is known to provide the main trigger of a firearm or the like with a so called secondary or 'hair' trigger which, when the main trigger is in the process of being pulled in order to fire a shot, first has to be activated before the main trigger can be pulled to a position where the firing mechanism of the firearm is operated to fire a shot.

Apart from improving the 'feel' of such a main trigger when it is being pulled, such a hair trigger also serves the purpose of a safety device guarding against the accidental movement of the main trigger to the position where a shot can be fired.

The known trigger related safety devices all suffer from some disadvantage or another.

Thus, for example, it is found that because of the manner in which such known secondary triggers operate, the firearm often can still accidentally be fired when it is for example dropped onto a hard surface and the resultant momentum of the fire arm components causes the said firing mechanism to be operated so that the shot is fired.

It is accordingly an object of this invention to provide a trigger related safety device with which the applicant believes the aforesaid problem can be overcome or at leat minimised.

According to the invention a trigger related safety device for a firearm or the like comprises a secondary trigger which is reciprocally movable relative to the main trigger between a first or operative position and a second or inoperative position, and a locking member associated with the secondary trigger which, when the latter is in the said operative position, serves positively to lock the main trigger to a stationery part of the firearm or the like so preventing the main trigger from moving in the direction where the firing mechanism of the firearm will be activated, and when the secondary trigger is in the said inoperative position, the main trigger is free to move in the said direction.

It will be appreciated that because of such positive locking of the main trigger when the secondary trigger is in the operative position, a shot cannot accidently be fired even if the firearm is dropped onto a substantially hard surface of the like.

It will further be appreciated that movement of the secondary trigger from said operative to inoperative positions will be similar to that of a 'hair' trigger and hence serve to improve the 'feel' of the main trigger.

Further according to the invention the movement of the secondary trigger from the operative to the inoperative positions takes place against the biasing action of a spring or the like.

When the pulling action on the secondary trigger is accordingly released, it will automatically move to the operative position where the main trigger and hence the firearm is rendered 'safe'.

Further according to the invention movement of the main trigger in the direction into which the firing mechanism of the firearm can be activated also takes place against the biasing action of a spring or the like.

Further according to the invention the said movement of the secondary trigger is in the same direction in which the main trigger has to move in order to activate the firing mechanism of the firearm, and the said locking member comprises a pin or the like which is located transversly relative to the aforesaid movement of the secondary trigger, the pin being slidably movable in a direction parallel to its own axis between a first position in which it engages a complementary catch formation on said stationary part of the firearm when the secondary trigger is in the said operative position, to a second position where it does not do so when the secondary trigger is in the said inoperative position.

Still further according to the invention said movement of the pin is accommodated in the bore of a transversely extending first slot or the like provided in the body of the secondary trigger, the main trigger including an aperture through which the end of the pin can extend in order to engage said catch formation on the stationary part of the firearm.

Still further according to the invention the said bore of the said first slot is of oval configuration in cross section so that apart from said longitudinal movement of the pin, the pin is also capable of movement in a direction parallel to the aforesaid movement of the secondary trigger, the pin also including along its length at least one transversely extending spigot which can slidably engage a second slot in the body of the secondary trigger which second slot extends at an angle relative to the said direction of movement of the secondary trigger and which slot also communicates with said first slot, the arrangement being such that when said spigot is moved along the second slot from its one end to the other, the pin is caused to move from its said first to second positions.

Preferably the said spigot extends on both sides of the pin and the secondary trigger includes a further slot similar to the said second slot so that the slots can each slidably accommodate opposite ends of the spigot.

Still further according to the invention the secondary trigger is of substantially T-shape in plan with the upper face of the head of the T defining a trigger finger engageable surface, and with the stem of the T being provided with said first and second slots.

Still further according to the invention the main trigger includes an apperture extending right through it in a direction parallel to that of the said movement of the main trigger; the secondary trigger being received slidably in the aperture to be movable therein between the said operative and inoperative positions.

Still further according to the invention the one end of said aperture in the main trigger is of such dimension that it can snugly receive the head of the T constituting the secondary trigger slidably, the dimensions of the other end of the aperture being such that it can snugly receive the leading end of the stem of said T slidably, the wider and narrower parts of the aperture being separated by two opposed shoulders in the bore of the aperture which each defines a seat for a suitable coil spring or the like responsible for said biasing action on the secondary trigger, the opposite seats for the springs being defined by the undersides of the head of the T.

Still further according to the invention the main trigger includes a blind hole into which a suitable coil spring or the like may be received for effecting the aforesaid biasing action on the main trigger.

Still further according to the invention the main trigger includes at least one formation adapted to receive the one end of a trigger bar of which the other end is connected to the firing mechanism of the firearm.

Still further according to the invention the main trigger includes a catch formation adapted to be engaged releasably by the main safety lock of the fire arm which, when so engaged, serves to lock the main trigger against any movement towards said firing position even if said secondary trigger is pulled.

One embodiment of the invention will now be described by way of example with reference to the drawings in which.

Figure 1:
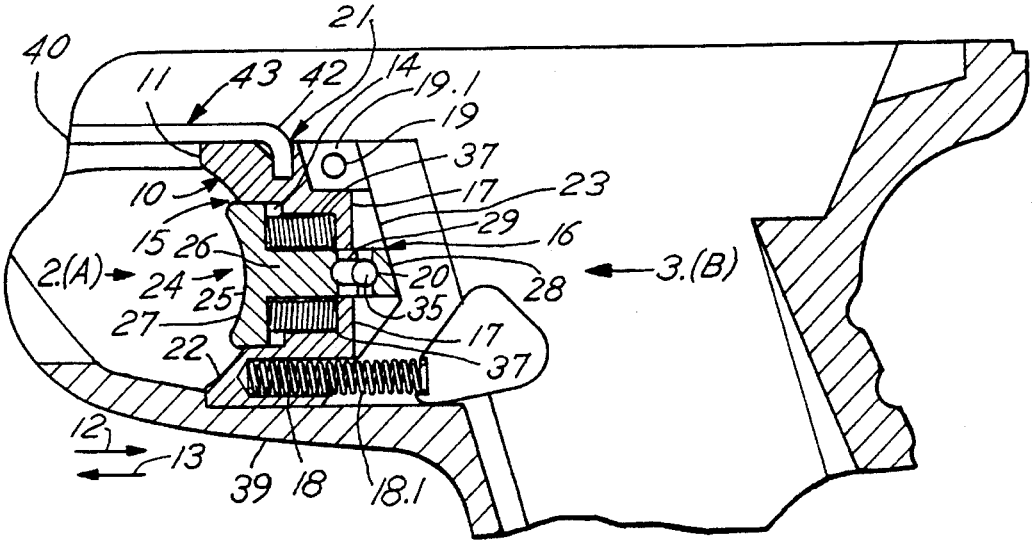
FIG. 1 is a diagrammatic cross sectional view of a trigger-related safety device according to the invention shown in position on the main trigger of a firearm.

In this embodiment of the invention a main trigger 10 for a firearm (not shown) comprises a body 11 of a suitable synthetic resinous material.

Trigger 10, which is of the so called sliding type, is capable of reciprocal movement in the direction indicated by arrow 12 (FIG. 1), where it can, when squeezed, move into a position where it activates the firing mechanism of the fire arm, and in the opposite direction indicated by arrow 13.

Trigger 10 includes an aperture 14 (clearly shown in FIG. 4) which extends right through it in a direction parallel to that indicated by arrows 12 and 13 and of which the one open end 15 is much wider than its other open end 16, the wider and narrower parts being separated by two transversely extending shoulders 17 (FIG. 1)located in the bore of aperture 14.

Trigger 10 also includes a blind hole 18 extending in a direction parallel to that indicated by arrows 12 and 13, which houses a coil spring 18.1; transversely extending apertures 19 and 20; and a transversely extending notch 21, the purpose of all of which will be explained later.

Figure 4:
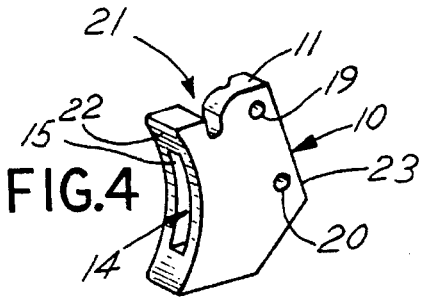

Face 22 of trigger 10, i.e. the one in which the wider end 15 of aperture 14 is located, is of smoothly curved configuration, while the opposite face 23, i.e. the one in which the narrower end 16 of aperture 14 is located, is of pointed arcuate configuration, as is clearly shown in FIG. 4.

A secondary trigger 24, comprising a member which is of substantially T-shape in plan view, has a head 25 which is of such dimensions that it can snugly fit slidably into end 15 of aperture 14, and a stem 26 of which the leading end 28 is of such dimensions that it can snugly fit slidably into end 16 of aperture 14.

The one face 27 of trigger 24 is of a curved configuration complementary to that of face 22 of trigger 10, while the opposite face 28 of stem 26 of trigger 24 extends at a sloping angle corresponding to that part of face 23 in which the open end 16 of aperture 14 is located.

Figure 6:
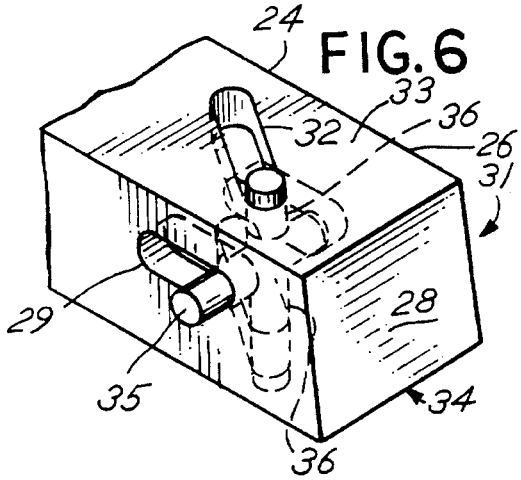

As can be clearly seen in FIG. 6, stem 26 of trigger 24 is provided with a first slot 29 which is of oval configuration in cross section and which extends between opposed faces 30 and 31 of stem 26 of trigger 24 in a direction perpendicular to the longitudinal axis of stem 26. Stem 26 also includes a second elongated slot 32 (FIG. 6) which extends between opposed faces 33 and 34 thereof at an angle of approximately 45° relative to the longitudinal axis of stem 26, the bore of the two slots 29 and 32 communicating with each other.

An elongated pin 35 (FIG. 6) which is of circular configuration in cross section is located in slot 29 for slidable movement therein in both the axial and radial directions.

Pin 35 is provided in a position spaced between its two ends with a transversely disposed spigot 36 which extends on both sides of pin 35, the ends of spigot 36 being slidably contained in opposed grooves 32 provided in faces 33 and 34 respectively of stem 26. Spigot 36 is located closer to that end of pin 35 located towards the rear end of the drawing in FIG. 6 so that that part of pin 35 located on that side of spigot 36 is much shorter than the part located on this side of spigot 36. Pin 35 and spigot 36 collectively define a substantial cross-shaped element which serves as a locking member for trigger 24, the operation of which will be described in more detail later.

In operation two coil springs 37 are located in aperture 14 in such positions that when trigger 24 is located via open end 15 into aperture 14, springs 37 are located on opposite sides of stem 26, with the opposite ends of the springs respectively seating on shoulders 17 and the underside of head 25 of trigger 24.

Springs 37 are of such lengths that when they are in the uncompressed condition shown in FIG. 1, face 27 of trigger 24 protrudes slightly beyond the edge of open end 15 of aperture 14.

In order to assemble the trigger arrangement, trigger 24 is pushed against the biasing actions of springs 37 in the direction of arrow 12 until the end 28 of its stem 26 passes through the open end 16 of aperture 14 and its slot 29 can move into register with aperture 20 in trigger 10 so that the end of pin 35 located on this side of spigot 36 can be located therein. Spigot 36 is then pushed via slot 32 until the protruding ends of spigot 36 are located in opposed slots 32, slot 38 (FIG. 3), provided on face 23 of trigger 10, facilitating such insertion.

When the pressure on trigger 24 is released, it returns under the influence of springs 37 towards its operative position shown in FIG. 1, while the cross-shaped locking member defined by pin 35 and spigot 36 remains trapped in slots 29 and 32 in the position shown in FIG. 6.

Coil spring 18.1 is then located in blind hole 18 and the assembled triggers 10 and 24 located in position in the frame 39 of the fire arm 40. The one end of an elongated trigger bar 19.1 is connected via aperture 19 to trigger 10, the other end of trigger bar 19.1 being connected to the firing mechanism (not shown) of firearm 40.

Figure 2:
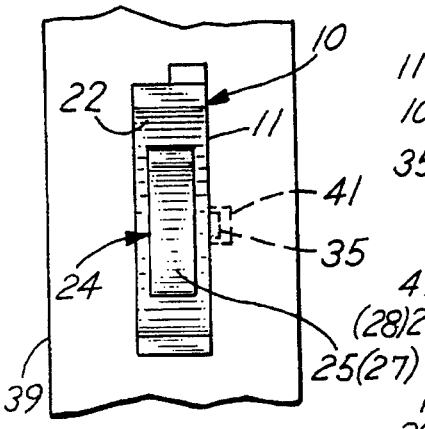
FIG. 2 is an end view of part of the arrangement of FIG. 1 as seen in the direction of arrow 'A' in FIG. 1.
Figure 3:
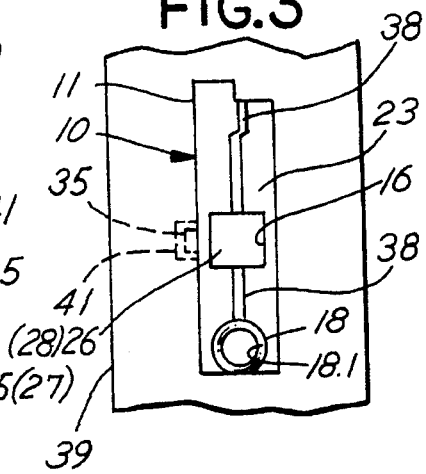
FIG. 3 is an end view of part of the arrangement of FIG. 1 as seen in the direction of arrow 'B' in FIG. 1.
Figure 5:
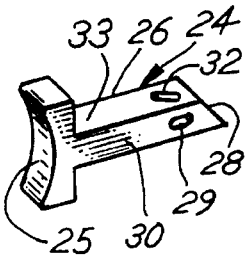
FIGS. 4 to 6 are diagrammatic perspective views showing some of the components of the arrangement of FIG. 1 in more detail.

While in this position, the free end of pin 35 projecting via slot 29 in stem 26 of trigger 24 and through aperture 20 in trigger 10 is adapted to engage a catch formation 41, comprising a blind hole, shown in dotted lines in FIGS. 2 and 3 on the said frame of the firearm 40 which catch formation 41 accordingly prevents trigger 10 from moving in the direction of arrow 12.

When pressure is now exerted, say by the trigger finger of a person operating the firearm 40, on trigger 24 in the direction of arrow 12, trigger 24, and hence stem 26, will move in this direction against the biasing action of springs 37. As a result of this movement of stem 26, spigot 36 will move along angled slot 32 towards its opposite end, thus causing the free end of pin 35 protruding through hole 20 to withdraw into hole 20 until its free end disengages catch formation 41 so leaving trigger 10 free, when squeezed, to move against the biasing action of spring 18.1 to the position where the said trigger bar 19.1 activates the firing mechanism (not shown) of firearm to fire a shot.

When the said finger pressure is released, triggers 10 and 24 move back to their original positions thus reversing the aforesaid movement of spigot 36 and pin 35 until the latter can again engage catch formation 41 on to frame 39 of the firearm 40.

It will accordingly be appreciated that apart from serving as a 'hair' trigger in the conventional sense, trigger 24 also serves to lock trigger 10 positively to frame 39 of firearm 40 thus rendering the latter 'safe' against accidental firing of a shot even if firearm 40 is dropped on a hard surface or the like.

Notch 21 on trigger 10 is adapted to be engaged by the hooked end 42 of a lever 43 of a safety device (not shown) which, when in operation, prevents trigger 10 from moving in the direction of arrow 12 even if pressure is being exerted on triggers 10 or 24 in the direction of arrow 12.

It will be appreciated that the invention also includes within its scope a firearm 40 provided with a trigger-related safety device according to the invention.

It will be appreciated still further that there are no doubt many variations in detail possible with a device and firearm 40 according to the invention without departing from the spirit and/or scope of the appended claims.

We claim:

1. A trigger related safety device for a firearm comprising a main trigger and a secondary trigger which is incorporated with the main trigger so that the secondary trigger is movable with the main trigger when the main trigger moves in a first direction when squeezed to fire the firearm, or in a second opposite direction when released; the secondary trigger being reciprocally movable relative to the main trigger between a first or operative and a second or inoperative position; and a locking member associated with the secondary trigger which, when the secondary trigger is in the said operative position, serves positively to lock the main trigger to a stationary part of the firearm so preventing the main trigger from moving in said first direction; and when the secondary trigger is in the said inoperative position, the main trigger is free to move with the secondary trigger in said first direction; the said locking member comprising an elongated pin having a longitudinal axis which extends transversely the said first and second directions, the pin being slidably moveable in at least one direction which extends parallel to the pin's longitudinal axis between a first position when one end of the pin engages a complementary catch formation on said stationary part of the firearm when the secondary trigger is in the said operative position to a second position where said one end of the pin is disengaged from the catch formation when the secondary trigger is in said inoperative position.

2. The device of claim 1 wherein the secondary trigger includes a transversely extending first slot which has a bore in which the pin is received for its said movement, and the main trigger includes an aperture through which the end of the pin can extend in order to engage said catch formation on the stationary part of the firearm.

3. The device of claim 1 wherein the secondary trigger includes a transversely extending first slot which has a bore in which the pin is received for its said movement; and the main trigger includes an aperture through which the said one end of the pin can extend in order to engage the said catch formation on the stationary part of the firearm, the said first slot having a bore which is of oval configuration in cross section, the pin also including along its length at least one transversely extending spigot, and the secondary trigger including a second elongated slot which has two ends and which has a bore which extends at an angle relative to the said first and second directions, which bore communicates with the said bore of the first slot; the said spigot being slidable in the second slot so that when said spigot is moved along the second slot from said one end of the second slot to the other end of the second slot, the pin is caused to move from its said first to second positions.

4. The device of claim 3 wherein the said spigot extends on both sides of the pin and the secondary trigger includes a further slot similar to the said second slot located in a diametrically opposed face of the secondary trigger so that the slots can each slidably accommodate opposite ends of the spigot.

5. The device of claim 4 wherein the secondary trigger is of substantially T-shape in plan comprising an elongated head and an elongated stem which extends transversely from the head, so that it has a free end remote from said head, the head furthermore having an upper face defining a trigger engagable surface and the stem including said first, second and further slots.

6. The device of claim 1 wherein the main trigger includes an aperture extending right through it in a direction parallel to that of said first and second directions; the secondary trigger being received slidably in the aperture to be movable therein between the said operative and inoperative positions.

7. The device of claim 1 wherein the main trigger includes a blind hole into which a coil spring may be received for effecting a biasing action on the main trigger in the said second direction.

8. The device of claim 1 including a spring which biases the secondary trigger towards its said operative position.

9. The device of claim 1 including a spring which biases the main trigger in the said second direction.

10. The device of claim 1 whereto the secondary trigger includes a transversely extending first slot which has a bore in which the pin is received for its said movement; and the main trigger includes an aperture through which the said one end of the pin can extend in order to engage the said catch formation on the stationary part of the firearm, the said first slot having a bore which is of oval configuration in cross section, the pin also including along its length at least one transversely extending spigot, and the secondary trigger including a second elongated slot which has two ends and which has a bore which extends at an angle relative to the said first and second directions, which bore communicates with the said bore of the first slot, the said spigot being slidable in the second slot so that when said spigot is moved along the second slot from said one end of the second slot to the other end of the second slot, the pin is caused to move from its said first to second positions; and wherein said spigot of the pin is accommodated in the bore of said transversely extending first slot provided in the body of the secondary trigger; and wherein the secondary trigger is of substantially T-shape in plan comprising an elongated head and an elongated stem which extends transversely from the head so that it has a free and remote from said head, the head furthermore having an upper face defining a trigger engagable surface, and the stem includes said first and second slots; and wherein the main trigger includes an aperture extending right through it in a direction parallel to that of said first and second directions; the secondary trigger being received slidably in the aperture to be moveable therein between the said operative and inoperative positions; and wherein the said aperture in the main trigger has two ends, one of which is of such dimension that it can snugly receive the said head of the secondary trigger slidably and the other end of the aperture being of such dimension that it can snugly receive said free and of the stem slidably, the two ends of the aperture being separated by two opposed holders in the aperture which each defines a seat for one end of an elongated coil spring which can bias the secondary trigger towards its operative position, the other end of the coil spring engaging the head of the secondary trigger adjacent the stem of the secondary trigger.

* * * * *